US005727602A

United States Patent [19]

Ema

[11] Patent Number: 5,727,602

[45] Date of Patent: Mar. 17, 1998

[54] WIRE GUIDING UNIT AND WIRE CUTTING APPARATUS

[75] Inventor: Hideyuki Ema, Yokkaichi, Japan

[73] Assignee: Sumitomo Wiring Systems, Ltd., Japan

[21] Appl. No.: 676,498

[22] Filed: Jul. 8, 1996

[30] Foreign Application Priority Data

Jul. 10, 1995 [JP] Japan ..... 7-173628

[51] Int. Cl.[6] ..... B21F 23/00

[52] U.S. Cl. ..... 140/102; 29/748; 29/857

[58] Field of Search ..... 140/102, 140; 29/33 F, 748, 755, 857; 72/230

[56] References Cited

U.S. PATENT DOCUMENTS

| | | | |
|---|---|---|---|
| 2,969,093 | 1/1961 | Jones | 140/140 |
| 3,893,316 | 7/1975 | Simich | 140/140 |
| 4,375,229 | 3/1983 | Mikami et al. . | |
| 4,428,114 | 1/1984 | Teagno | 29/857 |
| 5,327,628 | 7/1994 | Gouda . | |

FOREIGN PATENT DOCUMENTS 0 615 317 A2 9/1994 European Pat. Off. .

*Primary Examiner*—Lowell A. Larson

*Attorney, Agent, or Firm*—Anthony J. Casella; Gerald E. Hespos; Ludomir A.. Budzyn

[57] ABSTRACT

A wire guiding device 20 can be used in a machine for measuring and cutting a wire, and is adapted to curve the wire being fed substantially in U-shape during the measurement of the wire. The wire guiding device 20 includes a fixed guide block 21 and a movable guide block 22 rotatable with respect to the fixed guide block 21. The movable guide block 22 is rotated by a cylinder 51 so as to be displaceable between an engaging position where it is engaged with the fixed guide block 21 and a retracted position which is reached by its upward rotation from the engaging position. Since the movable guide block 22 is rotatable upward, i.e. in a direction under an angle, in particular normal to a feed direction of the wire, the wire can be fed at a high speed, realizing a faster measuring operation. This results in the rationalization of the manufacturing of wiring harnesses.

5 Claims, 8 Drawing Sheets

WIRE GUIDING UNIT AND WIRE CUTTING APPARATUS

BACKGROUND OF THE INVENTION

1. Field of the Invention

The present invention relates to a wire guiding unit for guiding a wire and curving it in U-shape when the wire is cut to a specified length in a process of manufacturing a wiring harness and also to a wire cutting apparatus for measuring and cutting a wire using the wire guiding unit.

2. Description of the Prior Art

A wiring harness to be mounted in an automotive vehicle or the like includes a multitude of final wires cut to a variety of lengths. These wires are bound so that the wiring harness looks like branches as a whole. Here, the final wires refer to wires (wire materials) cut to specified lengths and having necessary terminal fittings mounted at their ends.

Accordingly, the manufacturing of the wiring harness includes a multitude of steps:

(1) a wire cutting step of measuring the length of the wire and cutting the wire to a predetermined length so as to produce a wire material, (2) a peeling step of peeling an insulation coating from the ends of the cut wires (wire materials), (3) a terminal mounting step of connecting desired terminal fittings with the cores of the wires exposed by peeling, (4) a terminal inserting step of inserting the connected terminal fittings into the housings of the connectors, in the case that connectors are mounted at the ends of the wires, a binding step of binding the respective wires, and (5) a bundling step of bundling the respective wires.

The automatization of the respective steps has recently been promoted in order to rationalize the manufacturing of wiring harnesses. For example, the above steps (1) to (3) have been automatically sequentially performed as a series of operations. FIG. 6 diagrammatically shows the operations in the respective steps. With reference to FIG. 6, in order to automatically perform the respective wire processing steps as a series of operations, a cutting apparatus 1, a peeling apparatus 2 and terminal mounting apparatuses 3, 4, 5 are arranged in this order. Wires W cut by the cutting apparatus 1 are fed to the peeling apparatus 2 while the opposite ends thereof are aligned in parallel, i.e. while being curved substantially in U-shape. Thus, the cutting apparatus 1 is provided with a wire guiding unit for guiding the wires W while curving it in U-shape.

FIGS. 7(*a*), 7(*b*) and 7(*c*) are diagrams sequentially showing a measuring/cutting operation performed by the cutting apparatus 1. With reference to these FIGURES, the cutting apparatus 1 is a prior art pertinent to the present invention for which a prior application was filed by the applicant, and includes a wire feeder 6 for feeding the wire W while measuring a fed length of the wire W, and a wire guiding unit for curving the fed wire W in U-shape. Identified by C1 is a cutter for cutting the wire w, and by C2, C3 are clamps for gripping the opposite ends of the cut wire W.

FIG. 8 is a perspective view of an essential portion of the wire guiding unit 7 according to the prior application. With reference to FIG. 8, the wire guiding unit 7 includes a fixed guide block 7*b*, a movable guide block 7*a* and guide bars 7*c* for guiding a movement of the movable guide block 7*a*. The guide bars 7*c* are mounted on the fixed guide block 7*b*. The movable guide block 7*a* makes a linear movement along the guide bars 7*c* in directions toward and away from the fixed guide block 7*b*. Further, the movable guide block 7*a* is formed with a groove 7*d* as shown in FIG. 8.

As the movable guide block 7*a* moves toward the fixed guide block 7*b*, the guide blocks 7*a*, 7*b* come to engagement with each other. In this state, a U-shaped guide path 7*e* is defined between the movable guide block 7*a* and the fixed guide block 7*b*. Referring back to FIG. 7(a), the wire W fed by the wire feeder 6 is introduced into the guide path 7*e* and curved in U-shape while being guided along the guide path 7*e* (see FIG. 7(*b*)).

The leading end of the U-shaped wire W is gripped by the clamp C2. Subsequently, the movable guide block 7*a* is moved away from the fixed guide block 7*b* along the guide bars 7*c*. In this state, the wire W is measurably fed by a specified length (see FIG. 7(*c*)). The wire W fed by the specified length is cut by the cutter C1. The cut end of the wire W is gripped by the clamp C3. In this way, the wire measuring/cutting operation is completed and a wire material is produced.

In order to rationalize the manufacturing of wiring harnesses, the wire needs to be measured at a higher speed in the measuring operation. This demand may be met by increasing a feed speed of the wire by the wire feeder 6. However, the fed wire may ride up onto the movable guide block 7*a* if the feed speed of the wire is too fast. Unless the feed speed is too fast, the wire is so fed as to hang downward. However, if the feed speed becomes too fast, the wire does not hang downward, but is fed in a retracting direction of the movable guide block 7*a* by inertia. As a result, the wire W may strike against or ride up onto the movable guide block 7*a*, making a measurement error likely to occur. Specifically, if the feed speed of the wire W exceeds about 1000 mm/sec., the fed wire W rides up onto the movable guide block 7*a* by inertia, with the result that a measurement error may occur.

In view of the above, an object of the invention is to provide a wire guiding device and an apparatus capable of performing a measuring operation at a sufficiently high speed without causing an increase in a production cost.

SUMMARY OF THE INVENTION

In order to accomplish the object of the invention, a wire guiding unit which is used when a long wire is measurably fed by a specified length, comprises:

a first guide block having a curved or substantially semicircular or U-shaped first wall face, a second guide block having a second wall face which defines a substantially curved or semicircular or U-shaped wire guide path in cooperation with the first wall face while being at least partly engaged with the first wall face, the wire guide path being preferably adapted to guide the wire being fed such that a feed direction of the wire is reversed by about 180°, and displacement means for displacing the second guide block between an engaging position where the second wall face is at least partly engaged with the first wall face to define the wire guide path and a retracted position which is away from the engaging position in a direction under an angle, in particular substantially normal to the feed direction of the wire and where the wire guide path is exposed.

The wire guiding unit thus constructed operates as follows. The second wall face of the second guide block can be engaged with the first wall face of the first guide block by displacing the second guide block to its engaging position by the displacement means. In this state, the wall faces define the wire guide path together. On the other hand, by displacing the second guide block to its retracted position by the displacement means, the second wall moves away from the first wall face in the direction under an angle, in particular substantially normal to the feed direction of the wire.

When the second guide block is displaced to its engaging position, the wire being fed is introduced into the wire guide path from its leading end and is curved in U-shape while being guided along the wire guide path. If the second guide block is displaced to its retracted position in this state, the wire guide path is exposed. Further, the wire can be measured by being fed by the specified length.

Since the second guide block is displaced in the direction under an angle, preferably substantially normal to the feed direction of the wire, the second guide block is not located on a feed path of the wire when it is in its retracted position. Accordingly, even if the wire is fed at a high speed, it does not ride up onto the second guide block or is not interfered thereby.

According to the invention, since the second guide block in its engaging position is displaced in the direction under an angle, preferably substantially normal to the feed direction of the wire to its retracted position, the wire can be fed at a high speed after being curved into U-shape while avoiding an undesirable event where the wire rides up onto the second guide block or is interfered thereby. As a result, the measuring operation can be performed faster. Further, since the second guide block is displaced only in the direction under an angle, in particular substantially normal to the feed direction of the wire, no complicated construction needs to be adopted to displace the second guide block, suppressing an increase in the production cost of the wire guiding unit.

According to a preferred embodiment of the invention, the displacement means comprises a rotation mechanism for rotating the second guide block about a specified predetermined or predeterminable center of rotation.

The wire guiding unit thus constructed operates similar to the one according to the previous embodiment. In addition, the second guide block is displaceable between the engaging position and the retracted position by its rotation. In other words, the second guide block can be displaced by a simple displacing movement. Thus, a construction for displacing the second guide block can be simplified.

Accordingly, since the second guide block is displaced between its engaging position and its retracted position by a simple movement, namely rotation, a simple construction can be adopted to displace the second guide block, thereby further suppressing the production cost. Further, the second guide block can be easily moved at a high speed. Accordingly, the measuring operation can be performed even faster.

Further preferably, the rotation mechanism comprises a rotatable shaft which is connected or coupled with the first and second guide blocks and acts as a center of rotation of the second guide block, and a cylinder having one end connected or coupled with the first guide block and the other end coupled with the second guide block.

The wire guiding unit thus constructed operates similar to the one according to previous embodiment. In addition, since the second guide block is rotated about the rotatable shaft using the cylinder, the construction of the rotation mechanism can be very simple.

Accordingly, since the mechanism for rotating the second guide block has a very simple construction, namely a cylinder, the wire guiding unit can be inexpensively produced.

According to the invention there is further provided a wire cutting apparatus comprising:

a wire feeding device for withdrawing a long wire stocked in advance and feeding it along a specified pass line, a wire guiding device for guiding the wire being fed and curving it substantially in U-shape, and a cutting device for cutting the wire, and preferably adapted to produce a wire material of a specified length as an element of a wiring harness by measurably feeding the wire by the specified length by means of the wire guiding device and the wire feeding device and by cutting the measured wire by means of the cutting device, wherein the wire guiding device comprises the inventive wire guiding unit.

Thus there is provided a wire cutting apparatus capable of measuring and cutting a wire at a high speed so as to improve a wire material production performance.

With the wire cutting apparatus thus constructed, the wire guiding device operates similar to the wire guiding unit according to the above embodiments. More specifically, the wire being fed by the wire feeding device is curved in U-shape while being guided by the wire guiding device. The leading end of the wire curved in U-shape is gripped by a gripping device. Subsequently, the second guide block is displaced to its retracted position, and the wire is further fed by the wire feeding device. Accordingly, the wire can be measurably fed by the specified length without riding up onto the second guide block or being interfered thereby. The thus measured wire is gripped by the gripping device and cut by the cutting device so as to produce a wire material of the specified length.

Specifically, since the second guide block in its engaging position is displaced in the direction under an angle, in particular substantially normal to the feed direction of the wire to its retracting direction, the wire can be fed at a high speed after being curved in U-shape, thereby realizing a fast measuring operation. Accordingly, wire materials can be produced at a high speed. A suppressed increase in the production cost of the wire guiding unit leads to a suppressed increase in the production cost of the wire cutting apparatus. As a result, the manufacturing of wiring harnesses can be rationalized.

BRIEF DESCRIPTION OF THE DRAWINGS

These and other objects, features and advantages of the present invention will become more apparent upon a reading of the following detailed description and accompanying drawings in which.

DETAILED DESCRIPTION OF THE PREFERRED EMBODIMENT

Figure 1:
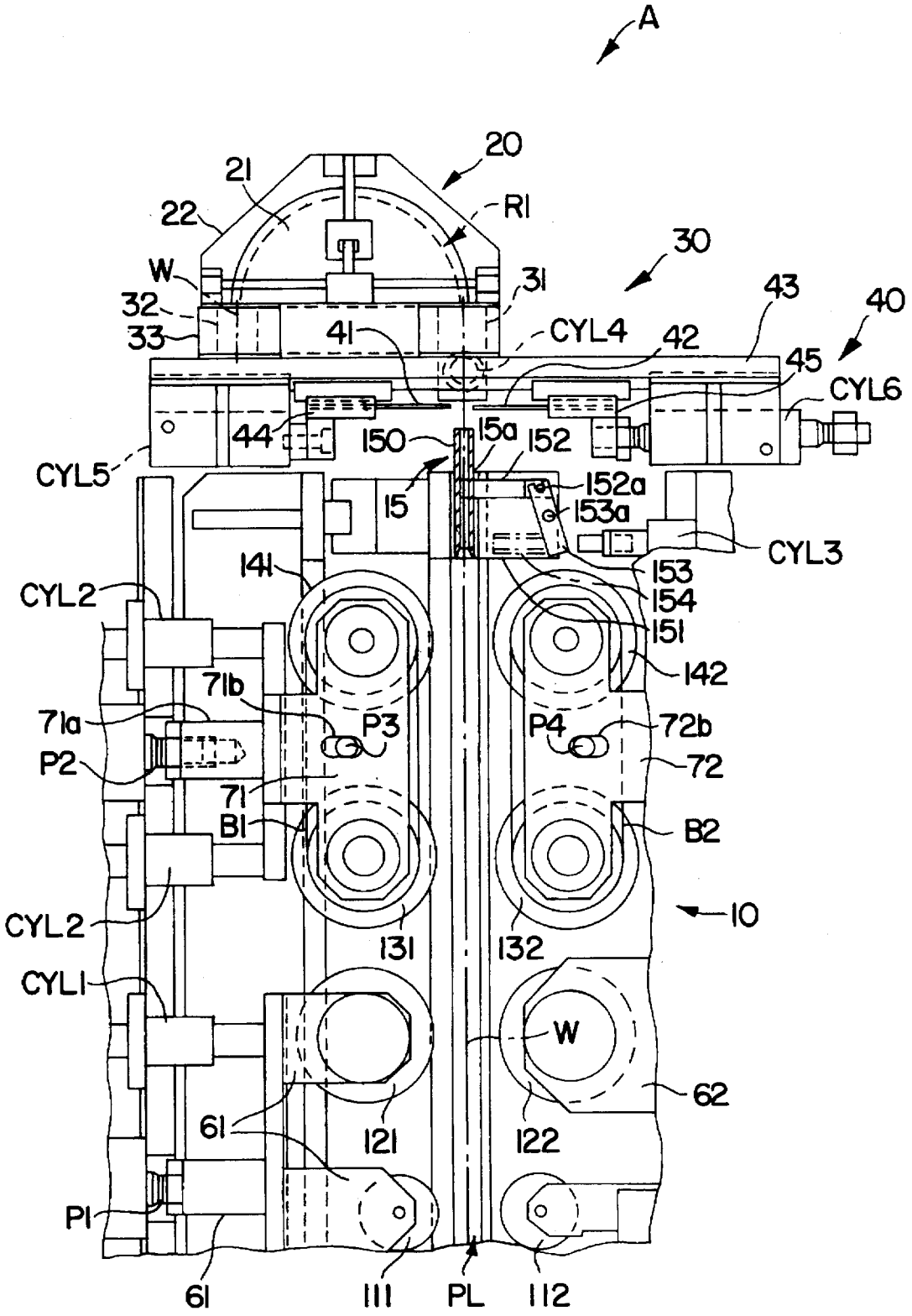
FIG. 1 is a plan view of an essential portion of a wire cutting apparatus according to one embodiment of the invention.

With reference to FIG. 1, a wire cutting apparatus A is used to prepare wire materials used in the construction of a wiring harness by measuring and cutting a wire to a specified length. The apparatus A is provided with a wire feeding device 10 for withdrawing a long wire W stocked in advance at an unillustrated location and feeding it along a pass line PL, a wire guiding device 20 arranged adjacent to the wire feeding device 10 and adapted to curve the wire W being fed in U-shape while guiding it, a clamping device 30 for gripping the wire W, and a cutting device 40 for cutting the wire W. In other words, the apparatus A prepares a desired wire material by feeding the wire W while curving it substantially in U-shape, gripping and cutting the wire W when it is fed by a specified length. Hereafter, the respective devices are described.

(1) Wire Guiding Device

Figure 2:
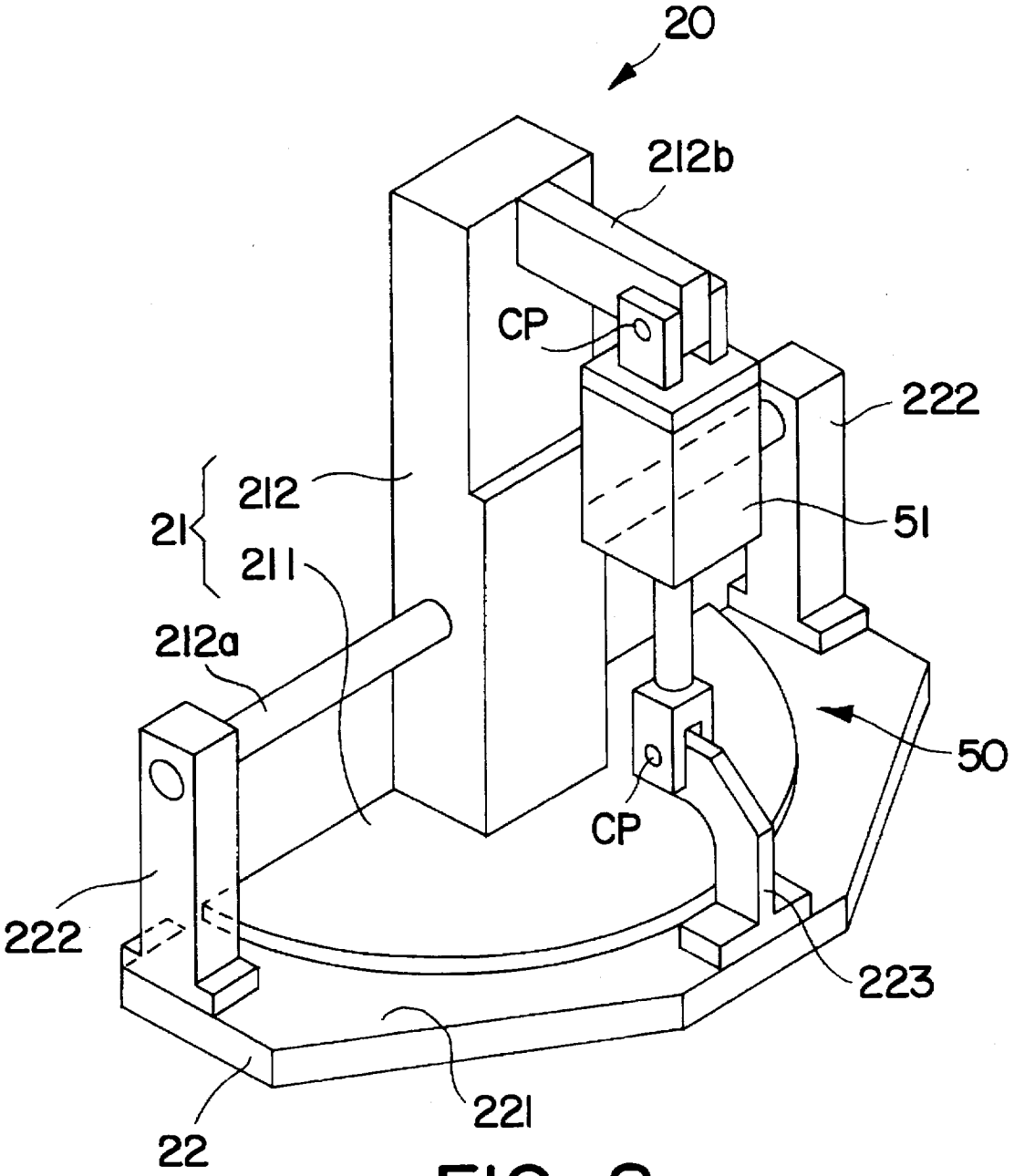
FIG. 2 is a perspective view of an entire wire guiding device.
Figure 3:
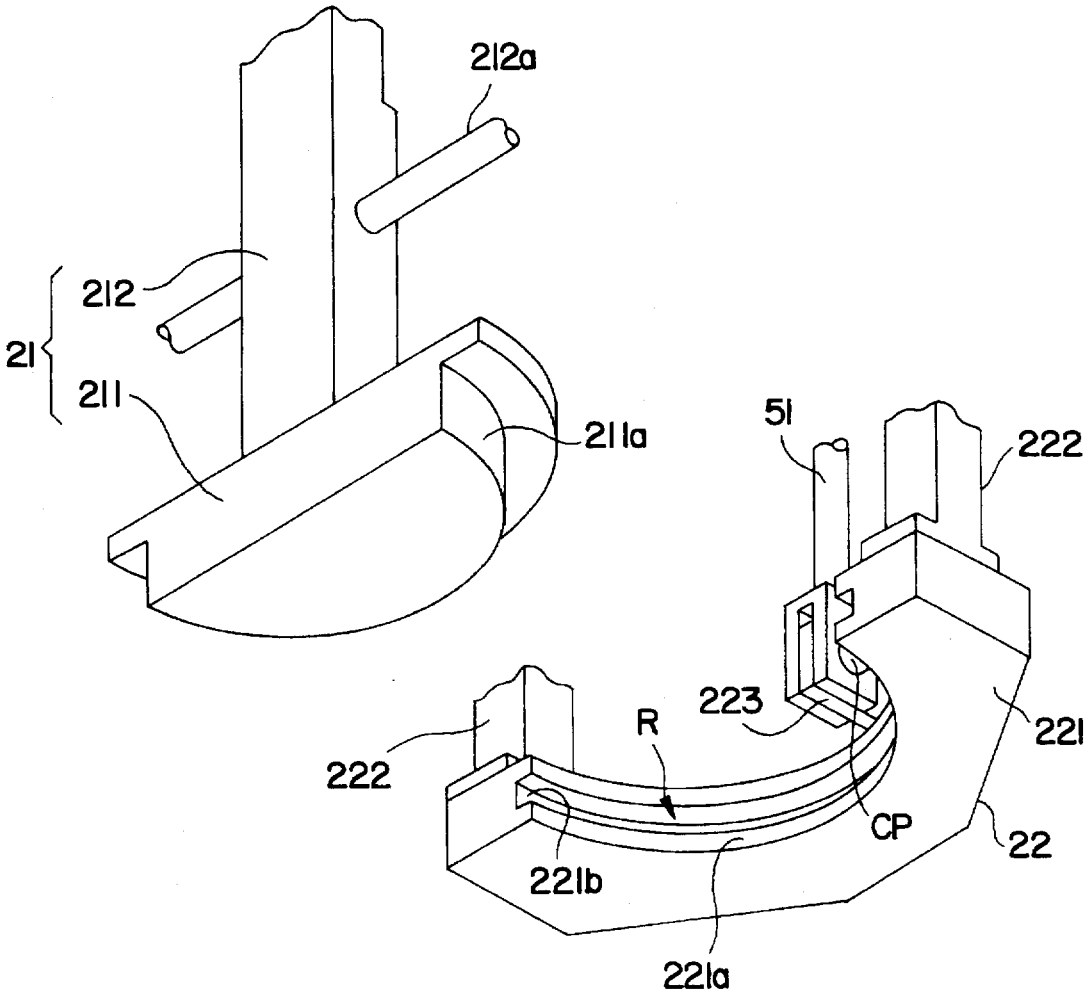
FIG. 3 is an exploded perspective view of an essential portion of the wire guiding device.

FIG. 2 is a perspective view of the wire guiding device 20, and FIG. 3 is an exploded perspective view of essential portions of a fixed guide block 21 and a movable guide block 22 when viewed obliquely from below. Hereafter, the wire guiding device 20 is described in detail with reference to FIGS. 1 to 3.

One feature of this embodiment lies in the construction of the wire guiding device 20.

(1) The wire guiding device 20 includes the fixed guide block 21, the movable guide block 22, and a displacement mechanism 50 for displacing the movable guide block 22 away, in particular upward with respect to the fixed guide block 21 (in a direction under an angle, preferably substantially normal to the extension of the pass line PL).

(2) The displacement mechanism 50 effects the above displacement by rotating the movable guide block 22.

(3) The displacement mechanism 50 includes a cylinder 51, and the movable guide block 22 is displaced by expansion and contraction of the cylinder 51.

With reference to FIG. 2, the wire guiding device 20 includes the fixed guide block 21, the movable guide block 22 and the displacement mechanism 50 provided with the cylinder 51 which linearly expands and contracts. In this embodiment, the wire guiding device 20 is formed as a single unit and is mountable on a wire cutting apparatus having another construction. Instead of forming the wire guiding device 20 as a single unit, the respective guide blocks 21, 22 and the cylinder 51 can be separately mounted on the wire cutting apparatus A.

With reference to FIG. 3, the fixed guide block 21 includes a substantially semicircular bottom plate 211 and a strut 212 standing substantially upright substantially in the center of the bottom plate 211. A stepped portion is formed at the peripheral wall of the bottom plate 211, thereby causing a bottom portion of the bottom plate 211 to project therefrom, in particular downward. The peripheral wall of the downward projecting portion forms a substantially semicircular projecting peripheral face or surface 211*a* as a first wall face. On the other hand, the strut 212 is in the form of a rectangle column. Pin members 212*a* and a mount member 212*b* (see FIG. 2) project from the strut 212. The pin members 212*a* extend in a horizontal direction and act as a rotatable shaft which is an element of the displacement mechanism 50. The mount member 212*b* is connected with a tube side of the cylinder 51.

The movable guide block 22 includes an engagement plate 221, rotatable arms 222 standing substantially upright at the opposite sides of the engagement plate 221, and a coupling member 223. The engagement plate 221 is formed with a substantially semicircular notch which enables engagement of the engagement plate 221 and the bottom plate 211. An inner face 221*a* of the notch is formed with a groove 221*b* dented in a direction normal to the inner face 221*a*. The inner face 221*a* formed with the groove 221*b* forms a second wall face engageable with the substantially semicircular projecting face 211*a*. In other words, the engagement of the first and second wall faces means the engagement of the bottom plate 211 and the engagement plate 221. As a result of the engagement, a substantially semicircular wire guide path R1 is defined by the projecting face 211*a* and the inner face 221*a*.

The respective rotatable arms 222 are in the form of rectangular columns and stand upright at the opposite sides of the engagement plate 221. A pin insertion hole is formed at an upper portion of each rotatable arm 222. The pin members 212*a* are rotatably inserted into the pin insertion holes. In other words, the movable guide block 22 is rotatably connected or coupled with the fixed guide block 21. The coupling member 223 is formed by a substantially L-shaped plate member and stands upright at the front end of the engagement plate 221. The leading end of the coupling member 223 is coupled with a rod side of the cylinder 51.

The displacement mechanism 50 includes the cylinder 51 and the pin members 212*a*. The cylinder 51 may be driven by a fluid and be e.g. an air cylinder or a hydraulic cylinder. The tube side of the cylinder 51 is rotatably coupled with the mount member 212*b* of the fixed guide block 21 via a coupling pin CP. On the other hand, the rod side of the cylinder 51 is rotatably coupled with the coupling member 223 of the movable guide block 22 via another coupling pin CP. Accordingly, the movable guide block 22 is displaceable between two positions: an engaging position and a retracted position, by expansion and contraction of the rod of the cylinder 51. Specifically, as the rod expands, the movable guide block 22 is displaced to the engaging position to be engaged with the fixed guide block 21. When the movable guide block 22 is displaced to the engaging position, the wire guide path R1 is defined (see FIG. 1). As the rod contracts from its expanded state, the movable guide block 22 is rotated upward from the engaging position to the retracted position. The displacement of the movable guide block 22 to its retracted position exposes the wire guide path R.

(2) Wire Feeding Device

Referring back to FIG. 1, the wire feeding device 10 withdraws the wire W from an unillustrated reel station and feeds it to the wire guiding device 20 along the pass line PL. Further, the wire feeding device 10 measures a fed length of the wire W in cooperation with the wire guiding device 20.

The wire feeding device 10 includes a pair of first feed rollers 141, 142, a pair of second feed roller 131, 132, and a pair of encoder rollers 121, 122. The first feed rollers 141, 142 and the second feed rollers 131, 132 are disposed at the opposite sides of the pass line PL, respectively so as to feed the wire W along the pass line PL while holding the wire W between the rollers 141, 142 and between the rollers 131, 132. The encoder rollers 121. 122 are adapted to measure a moved amount of the wire W moving along the pass line PL, and are disposed adjacent to the second feed rollers 131, 132 at an upstream side of the pass line PL (a bottom side in FIG. 1). The encoder rollers 121, 122 are also disposed at the opposite sides of the pass line PL such that they can hold the wire therebetween. By holding the wire W therebetween, the encoder rollers 121, 122 are caused to rotate by the wire W being fed. The moved amount of the wire W can be measured by counting a pulse generated during the rotation of the encoder rollers 121, 122 by an unillustrated counter.

The first and second feed rollers 141, 142, 131, 132 and the encoder rollers 121, 122 are slid by a slide mechanism to be described later. This enables the respective pairs of rollers to hold the wire W therebetween. Further, in this embodiment, there is provided a nozzle 15 for guiding the leading end of the wire W fed by the first and second feed rollers 141, 142, 131, 132 to the wire guiding device 20. The construction of the nozzle 15 is described in detail later. Identified by 111, 112 are rollers for detecting a seam of the wire W. The rollers 111,112 are not directly involved in the wire feeding/measuring operation.

Next, the slide mechanism is described. The slide mechanism is adapted to slide the first feed rollers 141, 142, the second feed rollers 131, 132 and the encoder rollers 141, 142 with respect to each other in the transverse direction of FIG. 1. In other words, the slide mechanism causes the respective pairs of the first feed rollers 141, 142, the second feed rollers 131, 132 and the encoder rollers 121, 122 to slide toward each other in the transverse direction to a measuring position where the rollers hold the wire W therebetween and to slide away from each other to a standby position where they cannot feed the wire W.

More specifically, the first feed roller 141 and the second feed roller 131 are slid as a single unit, and the first feed roller 142 and the second feed roller 132 are slid as a single unit. Further, the encoder roller 121 is slid together with the seam detecting roller 111, and the encoder roller 122 is slid together with the seam detecting roller 112.

The feed rollers 141, 131 are rotatably carried by a support member 71, and the feed rollers 142, 132 are rotatably carried by a support member 72. On the other hand, the encoder roller 121 and the seam detecting roller 111 are rotatably carried by a support member 61, and the encoder roller 122 and the seam detecting roller 112 are rotatably carried by a support member 62.

The feed rollers 141, 131 are coupled via an endless belt B1 so as to rotate together. A torque to rotate the belt B1 is given from an unillustrated motor. Likewise, the mating feed rollers 142,132 of the feed rollers 141, 131 are coupled via an endless belt B2 so as to rotate together.

The support member 71 is coupled with a cylinder CYL2. Specifically, a rod of the cylinder CYL2 is coupled with a rear face of a bent portion of the support member 71, and a tube thereof is fixed to a fixed frame of the support member 71. Although unillustrated, a cylinder is similarly coupled with the support member 72. On the other hand, a cylinder CYL1 is coupled with the support member 61. A rod of the cylinder CYL1 is coupled with a rear face of a bent portion of the support member 61, and a tube thereof is fixed to a fixed frame of the support member 61. Although unillustrated, a cylinder is similarly coupled with the support member 62.

Accordingly, as the rods of the cylinders CYL2, CYL1 expand, the first feed rollers 141, 142, the second feed rollers 131, 132 and the encoder rollers 121, 122 are slid to their measuring positions, respectively and hold the wire W therebetween. By rotating both pairs of feed rollers 141, 142 and 131, 132 by the motor, the wire W is fed along the pass line PL. The wire W being fed causes the encoder rollers 121, 122 to rotate, enabling them to measure a fed length of the wire W. On the other hand, as the rods of the cylinders CYL2, CYL1 contract, the first feed rollers 141, 142, the second feed rollers 131, 132 and the encoder rollers 121, 122 are slid to their standby positions, respectively, parting from the wire W.

Guide tubes 71*a*, 61*a* are provided at the rear faces of the bent portions of the support members 71, 61, respectively. In the fixed frames of the support members 71, 61, guide pins P2, P1 are so provided as to conform to the guide tubes 71*a*, 61*a*. Although unillustrated, the support members 72, 62 are similarly constructed. The respective guide pins P2, P1 project in a direction substantially normal to the pass line PL. Accordingly, as the cylinders CYL2, CYL1 expand, the rollers 141, 142, 131, 132, 121, and 122 are slid while the guide tubes 71*a*, 61*a* are guided by the guide pins P2, P1. As a result, the respective rollers are allowed to make a satisfactorily smooth sliding movement, maximally preventing them from shaking.

Further, roller supports of the respective support members 71, 72 are formed with oblong holes 71*b*, 72*b* extending in a direction substantially normal to the pass line PL. Stopper pins P3, P4 are inserted into the holes 71*b*, 72*b*, respectively. This arrangement accurately determines the end positions of the sliding movement of the respective support members 71, 72. Accordingly, the feed rollers 141, 142, 131, and 132 can be accurately brought to their nipping positions when they are going to hold the wire W therebetween, thereby realizing a satisfactory wire feed.

Next, the construction of the nozzle 15 is described.

The nozzle 15 includes a nozzle main body 150, a stopper arm 152 for opening and closing a nozzle hole of the nozzle main body 150, a cylinder CYL3 for moving the stopper arm 152, a link plate 153 disposed between the cylinder CYL3 and the stopper arm 152, and a spring 154 for biasing the link plate 153 in a specified direction. The nozzle main body 150, the stopper arm 152, the link plate 153 and the spring 154 are mounted on a beam 151. The beam 151 is so disposed as to bulge or project from the pass line PL and acts as a so-called bracket. The link plate 153 is rotatably mounted on the beam 151 via a pin 153*a*. Further, one end of the link plate 153 is rotatably coupled with the stopper arm 152 via a pin 152*a*.

A guide hole 15*a* is formed in the outer face of the nozzle main body 150. The stopper arm 152 is allowed to enter and exit from the nozzle main body 150 by being guided by the guide hole 15*a*. In other words, the nozzle hole is closed when the stopper arm 152 enters the nozzle main body 150, whereas it is opened when the stopper arm 152 comes out of the nozzle main body 150.

A tube side of the cylinder CYL3 is mounted on a fixed frame, and the leading end of the rod thereof faces the other end of the link plate 153. Further, the spring 154 elastically biases the other end of the link plate 153 toward the rod of the cylinder CYL3, with the result that the link plate 153 is constantly biased counterclockwise in FIG. 1. Thus, the stopper arm 152 is constantly biased in such a direction as to close the nozzle hole.

If the cylinder CYL3 is expanded to press the other end of the link plate 153 when a fed length of the wire W is to be measured, the link plate 153 rotates clockwise against the biasing force of the spring 154. As a result, the stopper arm 152 moves backward to open the nozzle hole, allowing the wire W to be fed. If the cylinder CYL3 is contracted upon completion of the measurement of the wire W, the link plate 153 rotates counterclockwise by the biasing force of the spring 154. As a result, the stopper arm 152 enters the nozzle main body 150, forcibly stopping the feed of the wire W by pressing the wire W against the inner wall of the nozzle main body 150.

(3) Clamping Device

The clamping device 30 is arranged between the wire feeding device 10 and the wire guiding device 20, and includes first and second clamps 31 and 32. The first clamp 31 is adapted to introduce the wire W being fed from the wire feeding device 10 into the wire guide path R1 of the wire guiding device 20 and to grip the wire W in the vicinity of a portion thereof to be cut by the cutting device after the measurement of the wire W. The second clamp 32 is adapted to grip the leading end of the wire W coming out of the wire guide path R1 after being curved in U-shape by the wire guide path R1.

The leading end of the first clamp 31 projects more toward the wire feeding device 10 than the second clamp 32 and is located in proximity to the nozzle 15 so that the it can grip the wire W coming out of the nozzle 15. The first and second clamps 31, 32 are mounted on an elevating block 33. A cylinder CYL4 is mounted on the rear face of the first clamp 31 to move the first clamp 31 upward and downward. In other words, the first and second clamps 31, 32 are integrally moved upward and downward by expansion and contraction of the cylinder CYL4.

When a fed length of the wire is to be measured, the cylinder CYL4 is expanded to bring the first and second clamps 31, 32 to positions where they face the entrance and exit of the wire guide path R1, respectively. Then, the leading end of the wire W being fed while being curved in U-shape by the wire guide path R1 is gripped by the second clamp 32. After the completion of the measurement, the wire W is gripped by the first clamp 31. Thus, the measured wire W can be cut while being held. By contracting the cylinder CYL4 after the wire W is cut, the clamps 31, 32 gripping the wire W can be moved downward.

(4) Cutting Device

The cutting device 40 is arranged between the wire feeding device 10 and the clamping device 30, and cuts the wire W to a specified length. The cutting device 40 includes a pair of cutting blades 41, 42 and a pair of cylinders CYL5, CYL6 for driving the cutting blades 41, 42, respectively. The cutting blades 41, 42 are mounted on beams of a U-shaped frame 43 straddling the first clamp 31 via guide members 44, 45 such that they face each other, and are movable toward and away from each other in a direction substantially normal to the pass line PL. The cylinders CYL5, CYL6 cause the cutting blades 41, 42 to move. Rods of the cylinders CYL5, CYL6 are mounted on the underside of the guide members 44, 45, and tubes thereof are mounted on the beams of the U-shaped frame 43.

The expansion of the respective cylinders CYL5, CYL6 causes the cutting blades 41, 42 to move toward each other to cut the wire W. In other words, upon completion of the measurement of the wire W, the cylinders CYL5, CYL6 are expanded. Then, the cutting blades 41, 42 are moved toward the wire W, and the wire W is cut to a specified length by crossing shearing faces of the cutting blades 41, 42.

Figure 4:
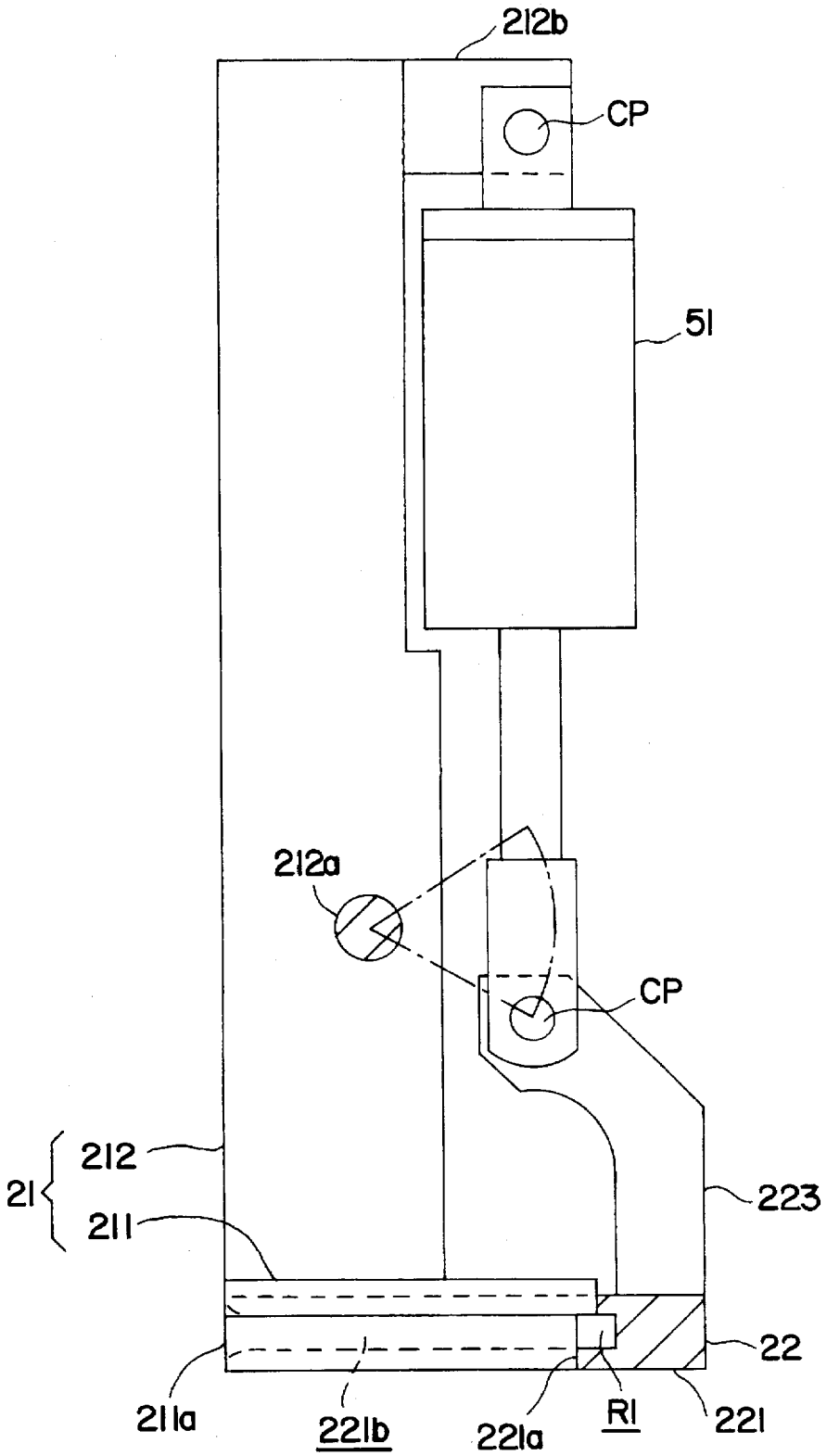
FIG. 4 is a side view of the wire guiding device when a movable guide block is in its engaging position.
Figure 5:
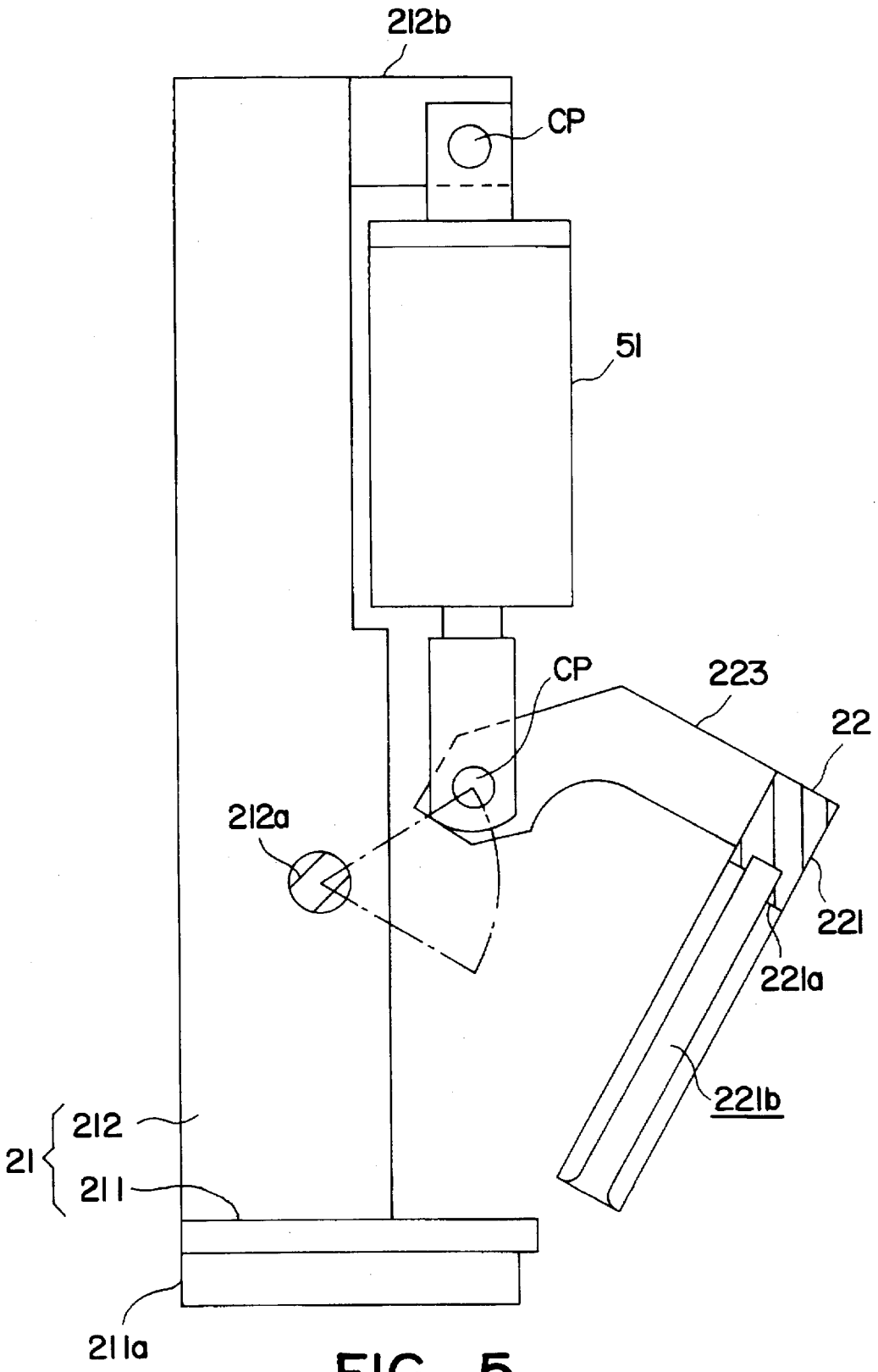
FIG. 5 is a side view of the wire guiding device when the movable guide block is in its retracted position.
Figure 6:
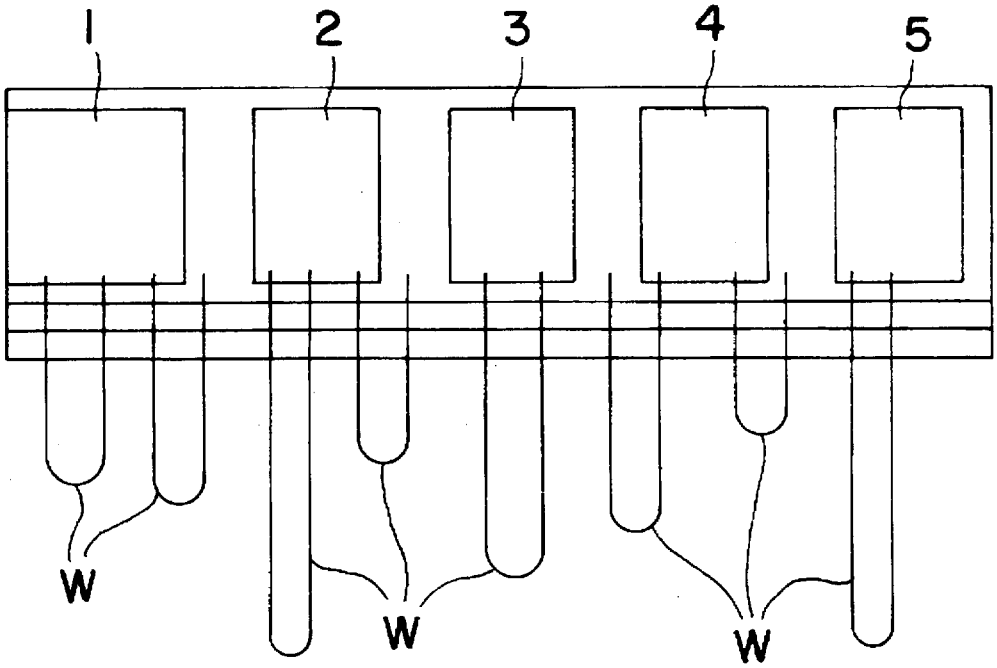
FIG. 6 PRIOR ART
FIG. 6 is a diagram showing operations in a measuring/cutting step, a peeling step and a terminal mounting step in a prior art manufacturing process of a wiring harness.
Figure 7A:
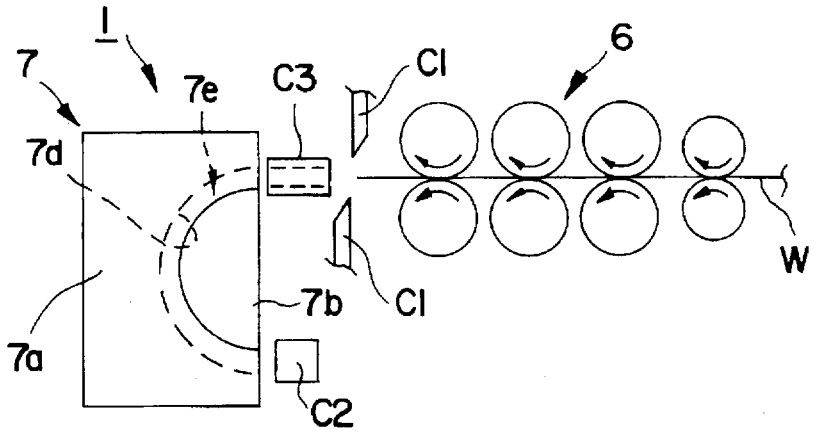
FIG. 7A PRIOR ART
FIGS. 7(*a*) to 7(*c*) are diagrams showing a prior art wire cutting apparatus.
Figure 7B:
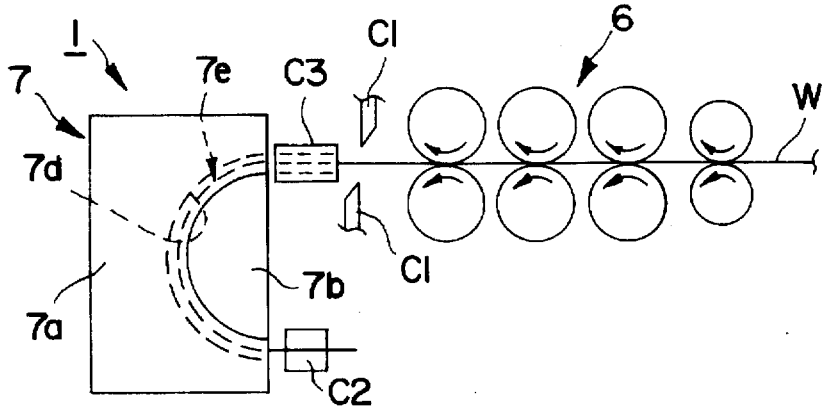
FIG. 7B PRIOR ART
Figure 7C:
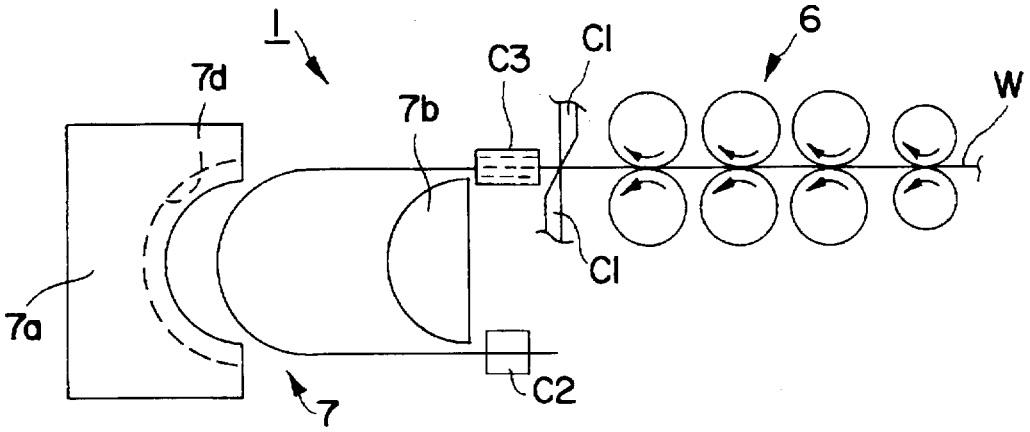
FIG. 7C PRIOR ART
Figure 8:
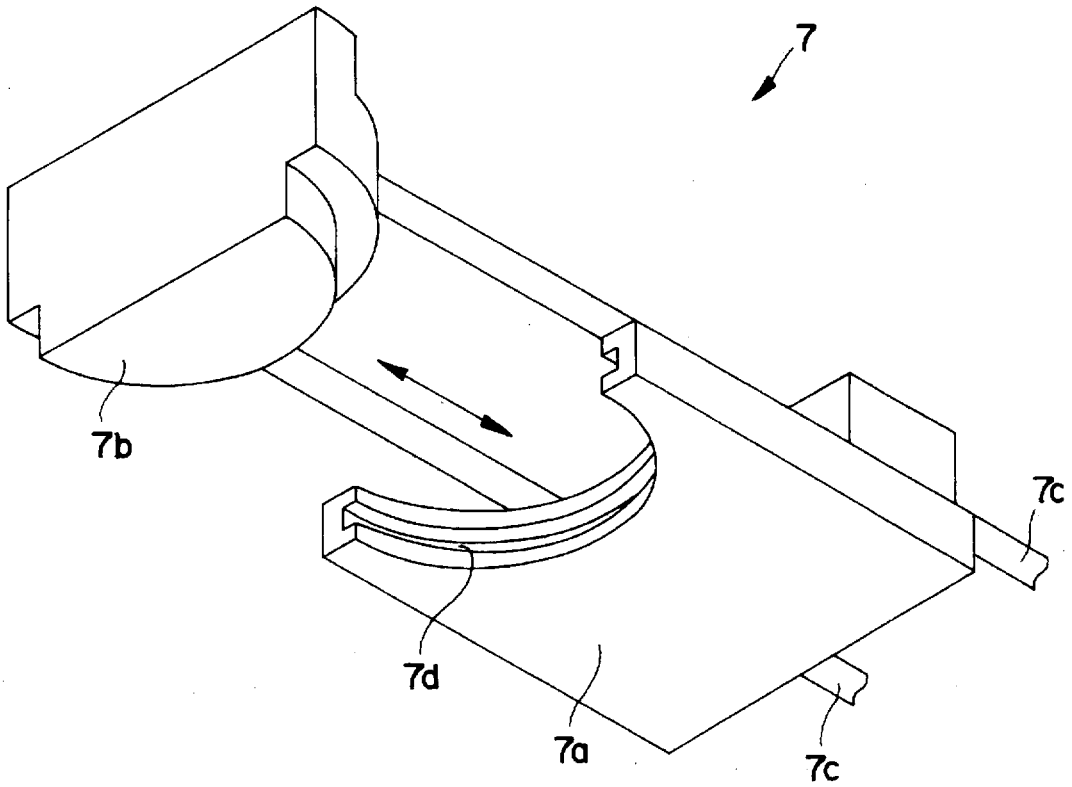
FIG. 8 PRIOR ART
FIG. 8 is a perspective view of an essential portion of a prior art wire guiding unit.

Next, the measuring/cutting operation by the wire cutting apparatus A is described together with its effects. FIGS. 4 and 5 are side views of the wire guiding device 20 when the movable guide block 22 is in its engaging position and when it is in its retracted position, respectively.

This embodiment operates as follows.

(1) The wire feeding device 10 feeds the wire W along the pass line PL. With reference to FIG. 5, the inner face 221*a* of the movable guide block 22 and the projecting face 211*a* of the fixed guide block 21 are engaged by displacing the movable guide block 22 to its engaging position by the displacement mechanism 50. In this state, the faces 221*a*, 211*a* define the wire guide path R1. Further with reference to FIG. 1, when the wire W is fed by the wire feeding device 10 in this state, the fed wire W is introduced into the wire guide path R1 from its leading end and is curved substantially in U-shape while being guided by the wire guide path R1.

(2) The leading end of the wire W thus curved substantially in U-shape is gripped by the second clamp 32 of the clamping device 30.

(3) Next, with reference to FIG. 5, by displacing the movable guide block 22 to its retracted position by the displacement mechanism 50, the inner face 221*a* of the movable guide block 22 moves from the projecting face 211*a* of the fixed guide block 21 in a direction under an angle, in particular substantially normal to a feed direction of the wire W. As a result, the wire guide path R1 is exposed. In other words, the movable guide block 22 is shifted and/or rotated out of a plane in which the wire is fed, in particular containing at least partly the pass line PL of the wire W, thus avoiding an interaction between the wire W being fed at high speed and the movable guide block 22. The movement (shift and/or rotation) of the movable guide block 22 is performed particularly such that it comprises a dynamic movement component oriented under an angle, in particular normal to the plane on which the wire W is being fed (in particular downstream from the nozzle 15).

(4) The wire W is further fed by the wire feeding device 10. The fed length of the wire W is measured by the encoder rollers 121, 122 so that the wire W is fed only by a specified length.

Since the movable guide block 22 is displaced in the direction under an angle, in particular substantially normal to the feed direction of the wire W, it is not located on a feed path of the wire W when it is in its retracted position. Accordingly, even if the wire W is fed at a high speed, the wire W being fed does not ride up onto the movable guide block 22 or is not interfered thereby, enabling a faster measuring operation. Further, since the movable guide block 22 is displaced only in the direction under an angle, in particular substantially normal to the feed direction of the wire W, a simple construction can be adopted to displace the movable guide block 22. Therefore, the wire guiding device 20 can be produced at a reduced cost.

(5) Upon completion of the measuring operation, the wire W is gripped by the first clamp 31 of the clamping device 30. Then, the wire W is cut by the cutting device 40 to produce a wire material of the specified length. Thus, according to the invention, the measuring operation can be performed at a high speed. As a result, the wire material producing performance of the wire cutting apparatus A is improved, contributing to the rationalization of the manufacturing of wiring harnesses.

(6) Particularly, this embodiment has the following effects in addition to the above effects.

The movable guide block 22 is displaceable between the engaging position and the retracted position by its rotation. In other words, since the movable guide block 22 is displaced by a simple displacing movement, namely rotation, a simple construction can be adopted to displace the movable guide block 22.

Specifically, the movable guide block 22 is displaced by the cylinder 51. By expanding the rod of the cylinder 51, the movable guide block 22 is rotated about the pin member 212*a* to its engaging position (see FIG. 4). Further by contracting the rod of the cylinder 51, the movable guide block 22 is rotated about the pin member 212*a* to its retracted position (see FIG. 5). The construction of the mechanism is very simple.

Accordingly, the movement of the movable guide block 22 can be made more fast and easily, with the result that the measuring operation can be performed even faster. This leads to an improved wire material producing performance of the wire cutting apparatus A, contributing to further rationalization. In addition, since the mechanism for displacing the movable guide block has a very simple construction, the wire guiding device 20 can be inexpensively produced, which advantageously leads to a reduction in the production cost of the wire cutting apparatus A.

The invention is not limited to the foregoing embodiment. For example, a solenoid may be used in place of the cylinder 51. Further, the mechanism for displacing the movable guide block 22 may be such that the pin member 212*a* is a rotatable shaft to which the movable guide block 22 is secured, and the movable guide block 22 is rotated by directly rotating the pin member 212*a* by means of a rotary actuator such as a motor. Further, although the movable guide block 22 is rotated upward to be displaced from its engaging position to its retracted position in the foregoing embodiment, it may be rotated downward for the same displacement. This modification has an advantage of a simpler construction if the movable guide block 22 is rotated taking advantage of its weight. A variety of other design changes are possible within the scope of the invention.

What is claimed is:

1. A wire guiding unit for guiding a wire (W) fed along a feed direction, comprising:

a first guide block (21) having a curved first wall face (211*a*), a second guide block (22) having a second wall face (221*a*) which defines a substantially curved wire guide path (R1) in cooperation with the first wall face (211*a*) while being at least partly engaged with the first wall face (211*a*), said curved wire guide path (R1) defining a plane, and displacement means (CYL5) for displacing the second guide block (22) between an engaging position where the second wall face (221*a*) is at least partly engaged with the first wall face (211*a*) to define the wire guide path (R1) and a retracted position which is away from the engaging position in a direction under an angle to the feed direction of the wire (W) and where the wire guide path (R1) is exposed, said displacement means (CYL5) comprising a rotation mechanism (222, 212*a*, 212, 212*b*, CP, 223) for rotating the second guide block (22) about a center of rotation that is parallel to and spaced from the plane of the curved wire guide path (R1).

2. A wire guiding unit according to claim 1, wherein the wire guide path (R1) is configured to guide the wire (W) being fed such that the feed direction of the wire (W) is reversed by about 180°.

3. A wire guiding unit according to claim 1, wherein the rotation mechanism (222, 212*a*, 212, 212*b*, CP, 223) comprises:

a rotatable shaft (212*a*) which is connected with the first and second guide blocks (21, 22) and acts as a center of rotation of the second guide block (22), and a cylinder (CYL5) having one end connected with the first guide block (21) and the other end connected with the second guide block (22).

4. A wire guiding unit according to claim 1, wherein the displacement means is operative for displacing the second guide block into a retracted position about an axis which is substantially normal to the feed direction of the wire.

5. A wire cutting apparatus, comprising:

a wire feeding device (10) for withdrawing a wire (W) stocked in advance and feeding it along a specified pass line (PL), a wire guiding device (20) for guiding the wire (W) being fed and curving it substantially in U-shape said wire guiding device comprising a first guide block (21) having a U-shaped first wall face (211*a*), a second guide block (22) having a second wall face (221*a*) which defines a substantially U-shaped wire guide path (R1) in cooperation with the first wall face (211*a*) while being at least partly engaged with the first wall face (211*a*), displacement means (CYL5) for displacing the second guide block (22) between an engaging position where the second wall face (221*a*) is at least partly engaged with the first wall face (211*a*) to define the wire guide path (R1) and a retracted position which is rotated about an axis substantially perpendicular to the pass line (PL) away from the engaging position in a direction under an acute angle to the pass line (PL) of the wire (W) and where the wire guide path (R1) is exposed, and a cutting device (40) for cutting the wire.

* * * * *